US005926145A

United States Patent [19]

Honma

[11] Patent Number: 5,926,145

[45] Date of Patent: Jul. 20, 1999

[54] BASE STATION FOR MOBILE COMMUNICATION

[75] Inventor: Tomoyuki Honma, Tokyo, Japan

[73] Assignee: NEC Corporation, Japan

[21] Appl. No.: 08/898,409

[22] Filed: Jul. 22, 1997

[30] Foreign Application Priority Data

Jul. 22, 1996 [JP] Japan ..... 8-191946

[51] Int. Cl.[6] ..... H01Q 1/12

[52] U.S. Cl. ..... 343/720; 455/561; 343/890

[58] Field of Search ..... 343/890, 702, 343/720; 455/90, 128, 129, 347, 561, 562; H01Q 1/12

[56] References Cited

U.S. PATENT DOCUMENTS 5,138,328 8/1992 Zibrik et al. ..... 343/702

5,267,297 11/1993 Kawano et al. ..... 455/561

FOREIGN PATENT DOCUMENTS 56-155481 11/1981 Japan ..... H05K 5/02

4-223724 8/1992 Japan ..... H04B 7/26

5-175678 7/1993 Japan ..... H05K 7/20

*Primary Examiner*—Michael C. Wimer

*Assistant Examiner*—Jennifer H Malos

*Attorney, Agent, or Firm*—Ostrolenk, Faber, Gerb & Soffen, LLP

[57] ABSTRACT

A base station for a mobile communication has flat antennas and sunshades. The flat antennas and sunshades are attached to portions of outer walls of a transceiver to cover the portions. The flat antennas function as a sunshade. The flat antennas are attached to such portions of the outer walls for optimum transmission and reception of radio wave, while the sunshades are attached to another portions of the outer walls.

8 Claims, 4 Drawing Sheets

BASE STATION FOR MOBILE COMMUNICATION

BACKGROUND OF THE INVENTION

1. Field of the Invention

The present invention relates to a base station for mobile communication, which is installed in the open air.

2. Description of Related Art

A conventional base station of the above kind is described in connection with FIG. 4. FIG. 4 is a perspective view of such a base station that is generally designated at 41. The base station 41 is comprised of a transceiver 42, an antenna 43 and a coaxial cable 44 interconnecting the antenna 43 and the transceiver 42. The transceiver 42 is attached to a predetermined portion of a structure. The antenna 43 is placed on another portion of the structure, which is suitable for receiving and transmitting radio waves. The relative position between the transceiver 42 and the antenna 43 depends on a site where the base station is installed. Thus, the length of coaxial cable differs from one job site to another, requiring adjustment work in optimizing electric characteristic.

There are cases where sunshades are used to prevent temperature rise of the transceiver 42. JP-A 55-155481 U (Utility Model) and JP-A 5-175678 propose examples of such sunshades.

JP-A 4-223724 proposes a base station utilizing a street lamppost. FIG. 5 shows a schematic sectional view of the street lamppost with the base station. In FIG. 5, the base station is generally designated at 51. A transceiver 52 and an antenna 53 are mounted within a lamppost 57*a* of a street lamp 57. A coaxial cable 54 extends through the lamppost 57*a* to interconnect the transceiver 52 and the antenna 53.

An object of the present invention is to provide a base station for a mobile communication, which requires little space to install, which has its electric parts protected against sunlight and which does not require any adjustment of electric characteristic at a job site.

SUMMARY OF THE INVENTION

According to the present invention, there is provided a base station for a mobile communication, comprising:

a transceiver having outer walls;

at least one antenna;

an electric conductor interconnecting said antenna and said transceiver; and sunshades arranged to protect said transceiver against sunlight, wherein said antenna and said sunshades are attached to said outer walls of said transceiver.

DESCRIPTION OF THE EMBODIMENTS

Figure 1:
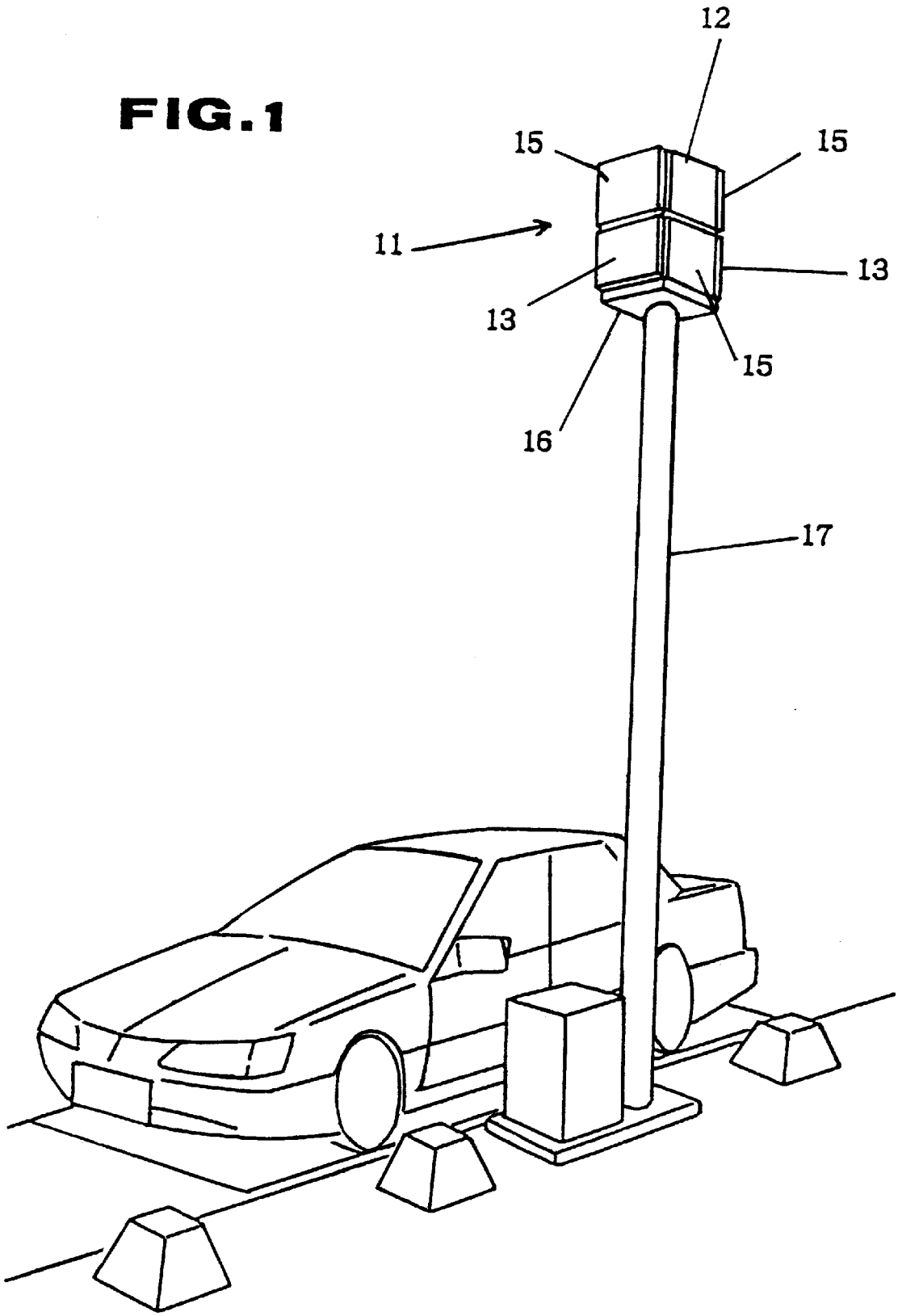
FIG. 1 is a perspective view of a first embodiment of a base station that is attached to a support post on a sidewalk.
Figure 2:
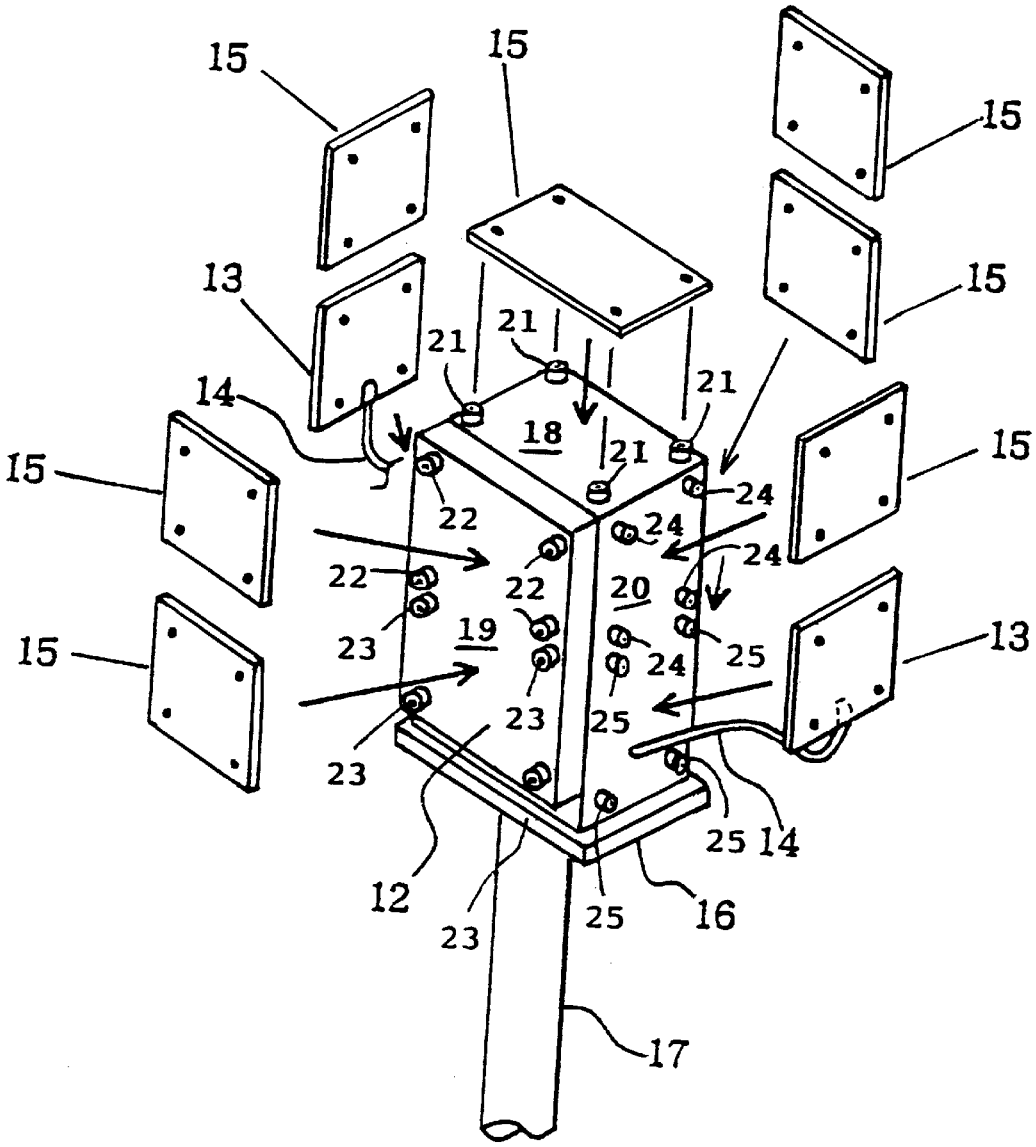
FIG. 2 is an enlarged fragmentary view of FIG. 1 with the base station exploded.

Referring to FIGS. 1 and 2, a base station is generally designated by the reference numeral 11. The base station 11 is comprised of a transceiver 12, and at least one, two in this embodiment, flat antenna 13. As seen in FIG. 2, a coaxial cable 14 interconnects the transceiver 12 and each of the flat antennas 13. The flat antennas 13 and a plurality of sunshades 15 cooperate with each other to cover the portions of outer walls of the transceiver 12 that are exposed to sunlight. In this embodiment, the bottom wall, viewing in FIG. 1, of the transceiver 12 is not covered by any of the sunshades 15 nor flat antennas 13. At this uncovered bottom wall, the transceiver 12 is attached to a flat mount site 16 of a support post 17 on a sidewalk.

As viewed in FIG. 2, the transceiver 12 includes a top wall 18 vertically spaced from the bottom wall and four peripheral walls. The four peripheral walls include a front wall 19, a rear wall, a right-hand wall 20, and a left-hand wall. The four peripheral walls are connected one after another and interconnect the vertically spaced top and bottom walls to define the configuration of the transceiver 12. In this embodiment, the top and bottom walls have the same rectangular contour. Among the four peripheral walls, the front and rear walls have the same rectangular contour, and the left-hand and right-hand walls have the same rectangular contour.

As best seen in FIG. 2, the top wall 18 has fixed thereto a group of four nuts 21 that are disposed at four corner portions thereof. The front wall 19 has fixed thereto a first group of four nuts 22 and a second group of four nuts 23. Similarly, the rear wall has a first group of four nuts and a second group of four nuts. The right-hand wall 20 has fixed thereto a first group of four nuts 24 and a second group of four nuts 25. Similarly, the left-hand wall has a first group of four nuts and a second group of four nuts. Bolts are used to attach the flat antennas 13 and sunshades 15 to the walls of the transceiver 12. Specifically, a single sunshade 15 is attached to the top wall 18 by tightening the bolts after inserting them into the nuts 21. Two sunshades 15 are attached to the front wall 19 by tightening the bolts after inserting them into the first and second groups of nuts 22 and 23. Similarly, two sunshades 15 are attached to the rear wall by tightening the bolts after inserting them into the first and second groups of nuts. A single sunshade 15 is attached to the right-hand wall 20 by tightening the bolts after inserting them into the first group of nuts 24. Similarly, a single sunshade 15 is attached to the left-hand wall by tightening the bolts after inserting them into the first group of nuts. One of the flat antennas 13 is attached to the right-hand wall 20 by tightening the bolts after inserting them into the second group of nuts 25. The other flat antenna 13 is attached to the left-hand wall by tightening the bolts after inserting them into the second group of nuts. The flat antennas 13 and sunshades 15 may be easily removed by releasing the bolts. Each of the flat antennas 13 functions as a sunshade.

According to the base station 11 shown in FIGS. 1 and 2, the sunshades 15 are easily attachable to the top wall and the four peripheral walls of the transceiver 12. Besides, any one of the sunshades 15 may be replaceable with flat antenna 13, which has the same attachment structure as and a similar contour to the sunshade 15 that is to be replaced. Such flat antenna 13 serves as a sunshade. Thus, among the five outer walls of the transceiver 12, most appropriate one or ones may be selected as mount sites for flat antennas 13 to optimize transmission and reception of radio waves upon installation of the base station 11 at a job site.

A coaxial cable 14 connects each of flat antennas 13 to the transceiver 12. The length of each of the coaxial cables 14 is predetermined and invariable. This has been accomplished because each of the flat antennas 13 is attached to one of the outer walls of the transceiver 12. Thus, it is no longer necessary to conduct electric adjustment, which was necessary in the prior art to deal with a change in the length of coaxial cable, upon installation of the base station 11 at a job site.

According to the base station 11, it is not necessary to find a site for an antenna at a location remote from the transceiver 12. Thus, the base station 11 may be installed if a small space is available. Such installation spaces may be found at top portions of masts that are arranged along a street for traffic control or supporting cables. If desired, the base station 11 may be mounted to one of such masts on the peripheral wall instead of the top by projecting the mount site 16 from the peripheral wall of the mast.

In the previously described embodiment, bolts and nuts are employed as fasteners for attaching the flat antennas 13 and sunshades 15 to the walls of the transceiver 12. Any fasteners may be used instead of the bolts and nuts, as long as they are easy to unlock.

Figure 3:
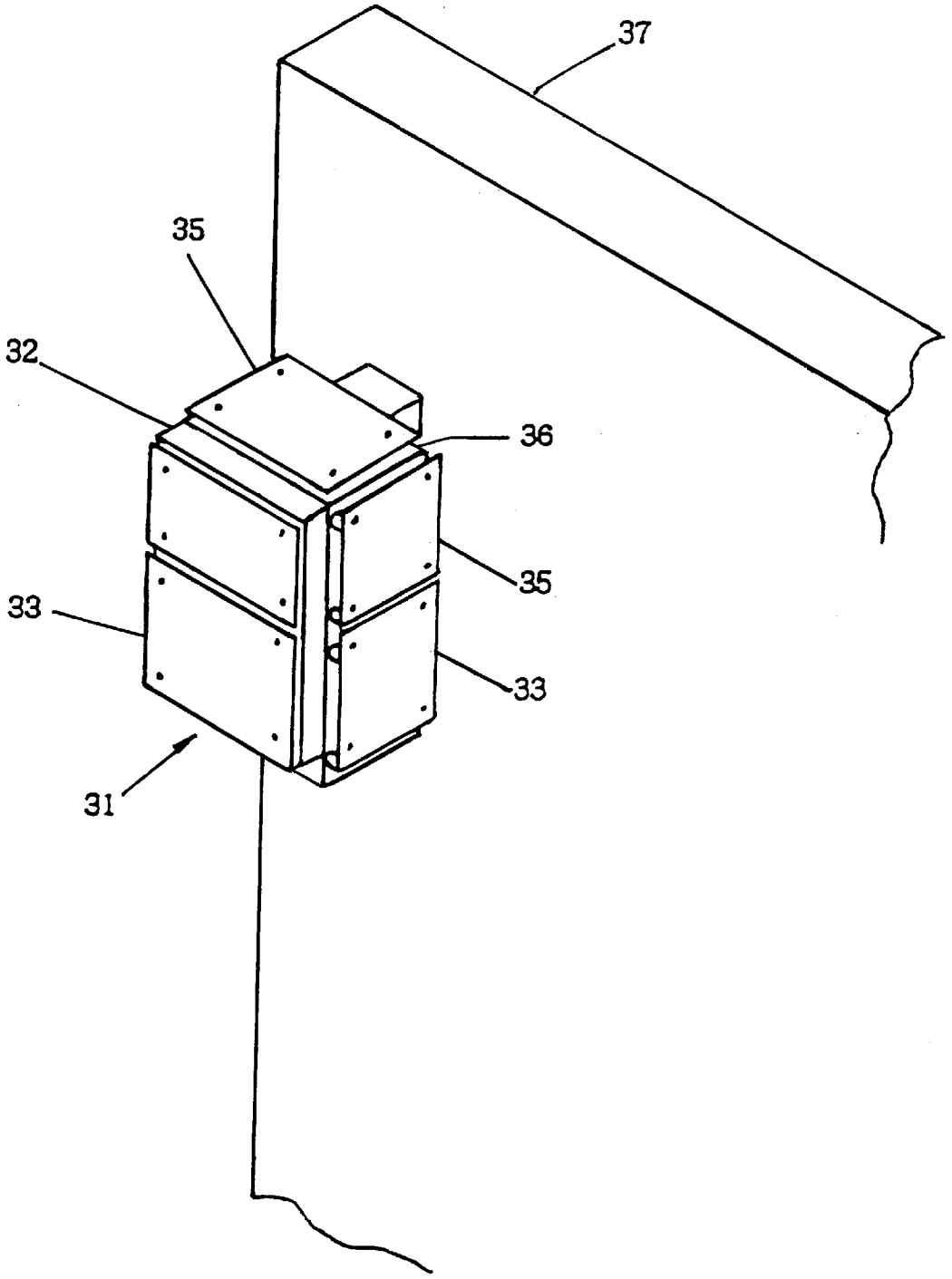
FIG. 3 is a perspective view of a second embodiment of a base station that is attached to a wall of a structure.
Figure 4:
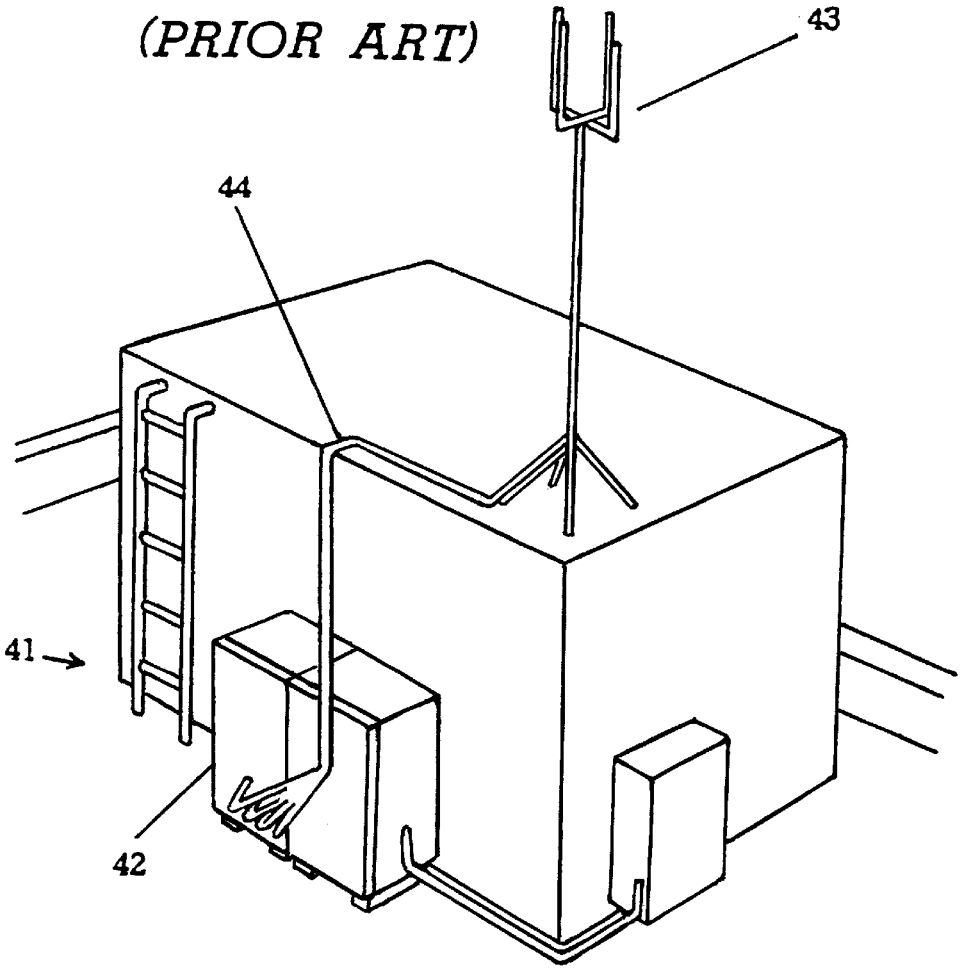
FIG. 4 (PRIOR ART)
FIG. 4 is a perspective view of one of the conventional base stations discussed before.
Figure 5:
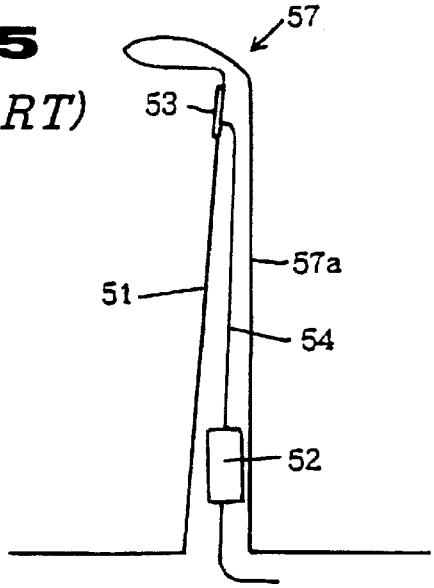
FIG. 5 (PRIOR ART)
FIG. 5 is a schematic sectional view of the other of the conventional base stations discussed before.

Referring to FIG. 3, the second embodiment of a base station 31 is described. The base station 31 is substantially the same as the base station 11. The base station 31 is comprised of a transceiver 32, flat antennas 33 that are attached to selected portions of the peripheral walls of the transceiver 32, and sunshades 35 that are attached to the portions of the outer walls of the transceiver 32 that are to be shaded.

The second embodiment is different from the first embodiment only in that the transceiver 32 has a rear wall 36, viewing in FIG. 3, uncovered by any sunshade. At this uncovered rear wall 36, the base station 31 is attached to a wall, such as a building wall, of a support structure 37.

What is claimed is:

1. A base station for mobile communication, comprising:

a transceiver having outer walls;

at least one antenna;

an electric conductor interconnecting said antenna and said transceiver; and sunshades arranged to protect said transceiver against sunlight, wherein said antenna and said sunshades are attached to said outer walls of said transceiver;

and further wherein said antenna has substantially the same contour as one of said sunshades and is attached to a first portion of said outer walls of said transceiver to serve as a sunshade to cover said first portion, wherein said sunshades are attached to second portions of the outer walls of said transceiver to cover said second portions.

2. A base station as claimed in claim 1, wherein said antenna is flat.

3. A base station as claimed in claim 2, wherein said antenna and said sunshades are detachable from said transceiver.

4. A base station as claimed in claim 3, wherein said antenna and said sunshades have identical attachment structures for attachment to said transceiver.

5. A base station as claimed in claim 1, wherein said electric conductor is a coaxial cable that has a predetermined invariable length.

6. A base station as claimed in claim 1, wherein one of said outer walls of said transceiver is uncovered by any one of said antenna or sunshades and set aside for attachment to a mount site.

7. A base station as claimed in claim 1 further comprising a support pole having an upper end, wherein said base station is attached to said upper end.

8. A base station as claimed in claim 1 further comprising a support structure having a wall, wherein said base station is attached to said wall of said support structure.

* * * * *